US007134225B2

(12) United States Patent
Ashton

(10) Patent No.: US 7,134,225 B2
(45) Date of Patent: Nov. 14, 2006

(54) PEDICURE SHOE

(76) Inventor: Lucy Ashton, 6505 Marsol Rd., Apt. 501, Mayfield Heights, OH (US) 44124

( * ) Notice: Subject to any disclaimer, the term of this patent is extended or adjusted under 35 U.S.C. 154(b) by 0 days.

(21) Appl. No.: 10/952,140

(22) Filed: Sep. 28, 2004

(65) Prior Publication Data

US 2006/0064902 A1 Mar. 30, 2006

(51) Int. Cl.
*A43B 7/26* (2006.01)

(52) U.S. Cl. ..... 36/94; 36/138

(58) Field of Classification Search ..... 36/94, 36/95, 138, 101, 50.1, 77 R, 72 R; D28/56, D28/61

See application file for complete search history.

(56) References Cited

U.S. PATENT DOCUMENTS

| | | | | |
|---|---|---|---|---|
| 1,090,731 | A | 3/1914 | Lindberg | |
| 1,129,670 | A * | 2/1915 | Hardesty | 602/30 |
| 1,349,095 | A | 8/1920 | Parisi | |
| 1,402,375 | A * | 1/1922 | Parisi | 602/30 |
| 2,507,120 | A * | 5/1950 | Shapiro | 36/11.5 |
| 2,751,693 | A * | 6/1956 | Baker | 36/94 |
| 2,808,662 | A * | 10/1957 | Webb | 36/11.5 |
| 4,017,987 | A * | 4/1977 | Perez et al. | 36/11.5 |
| 4,207,880 | A * | 6/1980 | Zinkovich | 602/30 |
| D271,156 | S | 11/1983 | Williamson | |
| 4,793,075 | A | 12/1988 | Thatcher | |
| D306,084 | S | 2/1990 | Volz et al. | |
| 4,967,750 | A | 11/1990 | Cherniak | |
| 5,483,757 | A | 1/1996 | Frykberg | |
| 5,533,278 | A | 7/1996 | Stein | |
| 5,926,978 | A * | 7/1999 | Smith | 36/101 |
| 5,946,823 | A | 9/1999 | Yates | |
| D420,785 | S | 2/2000 | Perez | |
| 2004/0025372 | A1 | 2/2004 | Watanabe | |

* cited by examiner

*Primary Examiner*—Ted Kavanaugh
(74) *Attorney, Agent, or Firm*—Renner, Otto, Boisselle & Sklar

(57) ABSTRACT

A protector for toes is provided including a toe enclosure configured to block exposure of the toes to an environment external of the enclosure. The toe enclosure may be a footwear article configured to protect the toes. A pedicure shoe system is also provided for protecting freshly painted toe-nails from contact with foreign objects. The pedicure shoe system includes a pedicure shoe and a pedicure slipper. The pedicure slipper is positionable in the pedicure shoe, and spacer members ensure adequate space between the pedicure shoe and the toe-nails.

8 Claims, 7 Drawing Sheets

PEDICURE SHOE

FIELD OF THE INVENTION

The present invention relates generally to footwear items and more particularly to pedicure footwear.

BACKGROUND

Pedicures are typically performed in a salon or spa. During a pedicure, a foot may be treated with creams, lotions, hot wax or other skin conditioning softeners. Typically, a pedicure also includes painting the toe-nails of the foot with nail polish. Nail polish may require a minimum of one hour to dry, during which time it is important to prevent any material or foreign objects from contacting the freshly coated toe-nails. As is well known to individuals who obtain pedicures, even if the polish is dry to the touch, the polish can scratch easily should the individual attempt to wear tight fitting shoes or inadvertently come into contact with another surface before the polish has cured to its final density and hardness.

During a pedicure, toe-separating slippers often are used to assist a pedicurist by inhibiting the toes from touching each other during application of nail polish to each toe. The most basic pedicure slippers are generally made from a disposable paper fabric. More sophisticated slippers may include a semi-rigid sole and enable the individual receiving the pedicure to walk immediately or to drive a car with freshly polished toe-nails. The ability to walk or to drive a car with freshly polished toenails eliminates the need for the individual receiving the pedicure to remain at the salon until the nail polish dries. However, conventional pedicure slippers and shoes are not generally suitable for use in inclement weather. For example, in northern latitudes during the winter months, conventional pedicure slippers and shoes do not provide suitable warmth and protection from slush and snow. Further, typical pedicure slippers may not be appropriate footwear for many occasions. Even if conventional pedicure shoes or slippers allow an individual to depart a salon before the polish is dry, the individual may be limited by the informal qualities of conventional pedicure shoes or slippers as to where he or she may go. Thus, while conventional pedicure shoes and slippers may be practical in a few instances, in many instances they are inadequate.

Many conventional pedicure shoes and slippers, for example the shoes and slippers disclosed in U.S. Pat. No. 4,017,987 to Perez; U.S. Pat. No. 5,870,837 to Poulos; U.S. Pat. No. 6,226,893 to Schlamp, et al, and U.S. Pat. No. 6,298,580 to Tadayan, separate a wearers toes to prevent the toes from inadvertently marring the freshly polished nails. Some pedicure shoes and slippers also protect the freshly polished nails from contact with other surfaces or materials. For example, U.S. Pat. No. 5,946,823 to Yates ("Yates") discloses a pedicure slipper system including a slipper assembly having a plurality of toe separation cushion assemblies on the sole of the slipper assembly and a removable toe cover assembly for shielding the toes. The removable toe cover assembly may be installed over the forward part of an individual's foot, including the toes, after the foot is inserted in the slipper. While the Yates slipper separates an individual's toes and provides some protection to freshly polished nails, it does not provide adequate protection from the elements to the individual wearing the slipper.

Therefore, it is desirable to provide a pedicure shoe system wherein a foot may be easily inserted into the shoe while wearing a pedicure slipper, wherein the pedicure shoe provides additional protection to the freshly coated toes, and wherein the pedicure shoe is configured to provide the comfort and versatility similar to a conventional shoe.

From the foregoing it will be seen there is room for improvement of pedicure shoes.

SUMMARY OF THE INVENTION

A protector for toes of a foot is provided comprising: a toe enclosure configured to block exposure of the toes to an environment external of the enclosure, a foot support member positionable in the toe enclosure, and at least one spacer member configured to maintain a space between the toes and the toe enclosure when the foot support member is positioned in the toe enclosure.

A pedicure shoe system for protecting the toes of a foot is also provided comprising: a shoe member having a shoe sole and an upper attached to at least a portion of the perimeter of the shoe sole thereby defining a cavity, the upper including a mouth portion and a toe enclosure releasably attachable to at least a portion of the shoe sole, a slipper member positionable in the cavity of the shoe member, the slipper member having a slipper sole and a strap member attached to the slipper sole, and at least one spacer member configured to separate at least a top part of the slipper from the toe enclosure when the slipper member is positioned in the shoe member.

In addition, a pedicure shoe is provided comprising: a shoe member having a shoe sole and an upper attached to at least a portion of the perimeter of the shoe sole thereby defining a cavity, the upper including a mouth portion and a toe enclosure releasably attached to at least a portion of the shoe sole. The toe enclosure is configured to be at least partially removed to allow a foot to be inserted into the shoe.

Further, a pedicure slipper is provided comprising: a slipper sole, a strap member attached to the slipper sole, and at least one spacer member attached to the strap member.

A method of protecting toes of a foot is also provided. The method comprises: placing a foot in a foot support member, positioning the foot with the foot support member in a toe enclosure configured to block exposure of the toes to an environment external of the toe enclosure, and spacing the toe enclosure from the foot with at least one spacer member.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views.

DETAILED DESCRIPTION OF THE INVENTION

Figure 1:
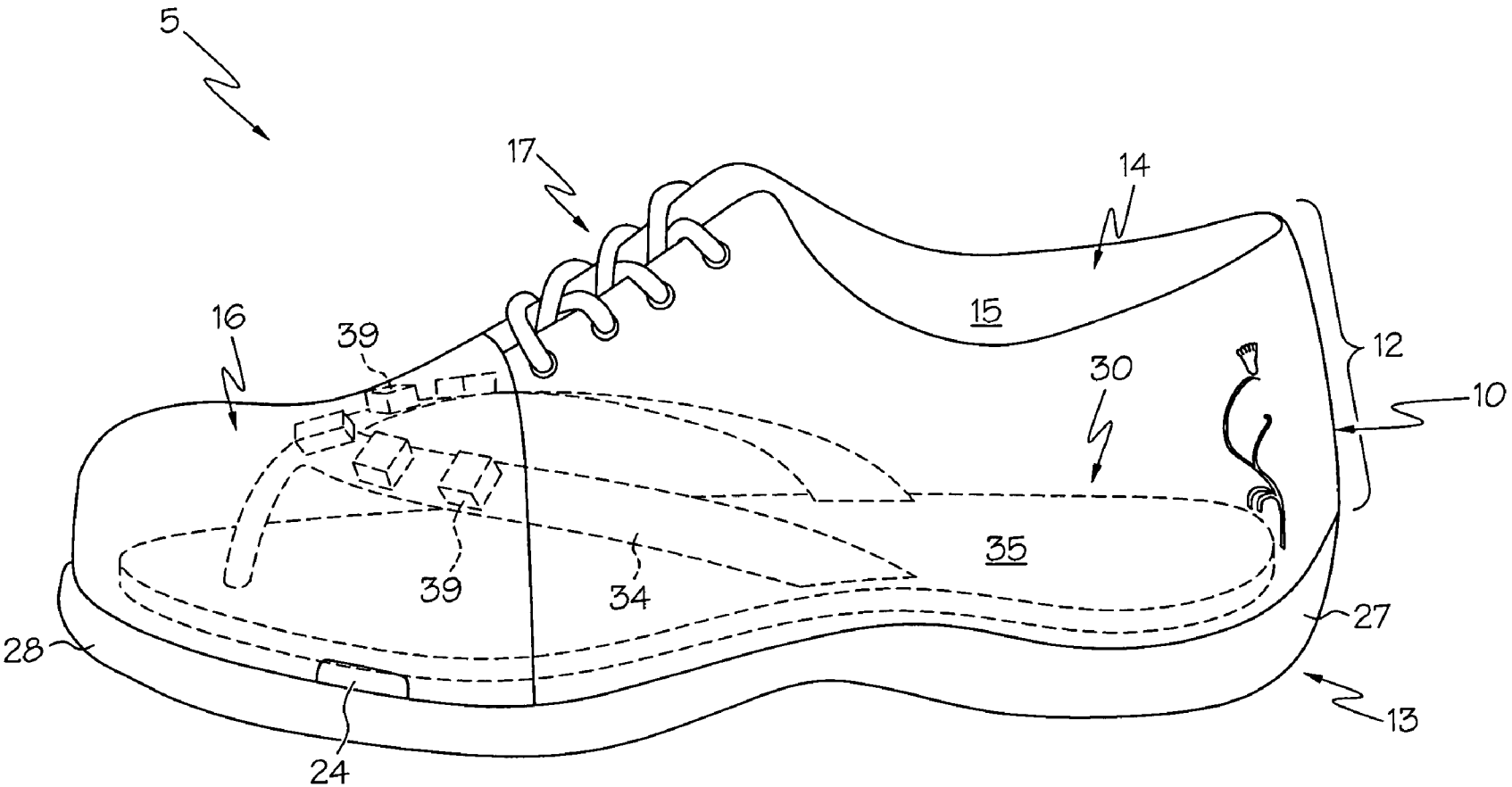
FIG. 1 is a side view of a pedicure shoe with the toe flap in the closed position.
Figure 2:
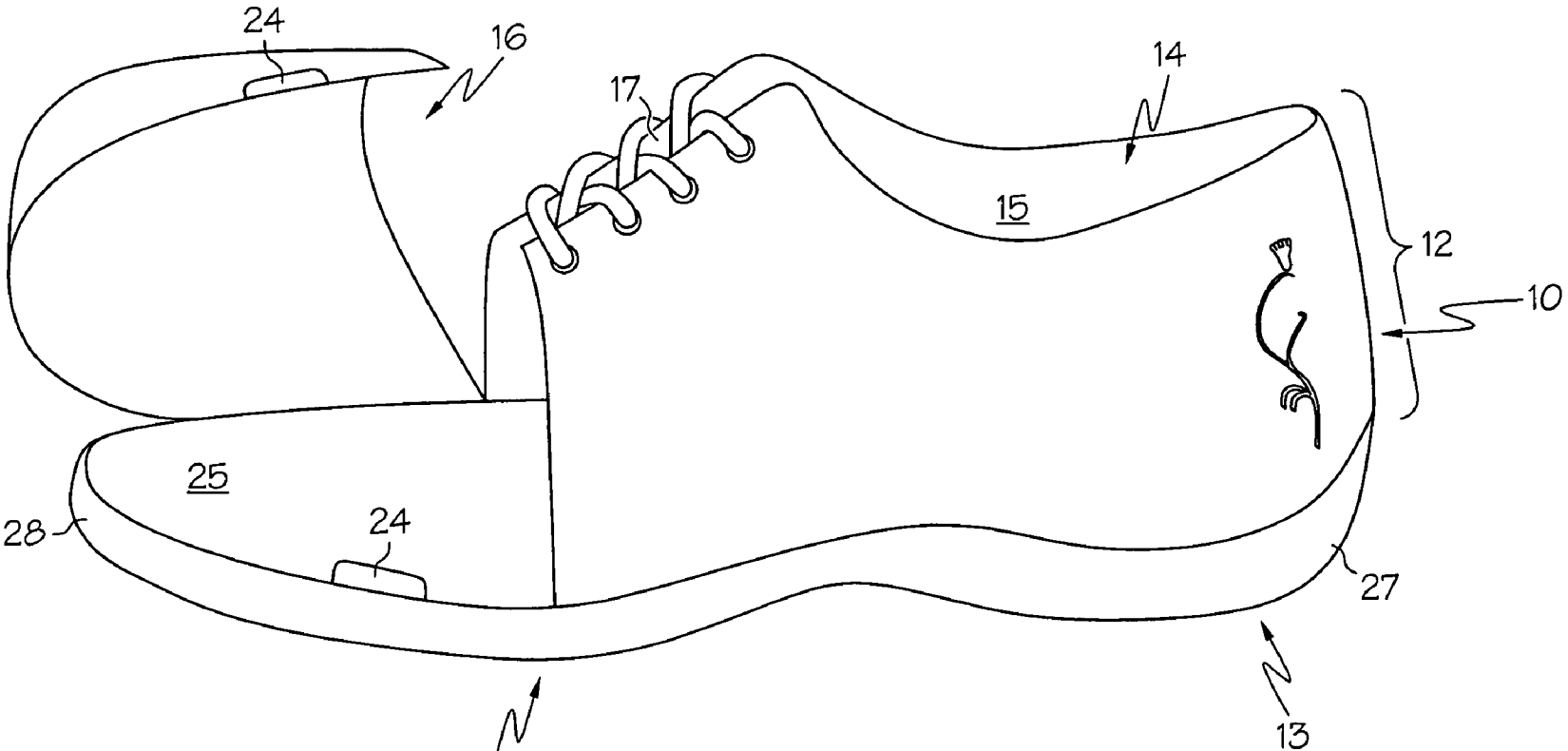
FIG. 2 is a side view of a pedicure shoe with the toe flap in an open position.
Figure 3:
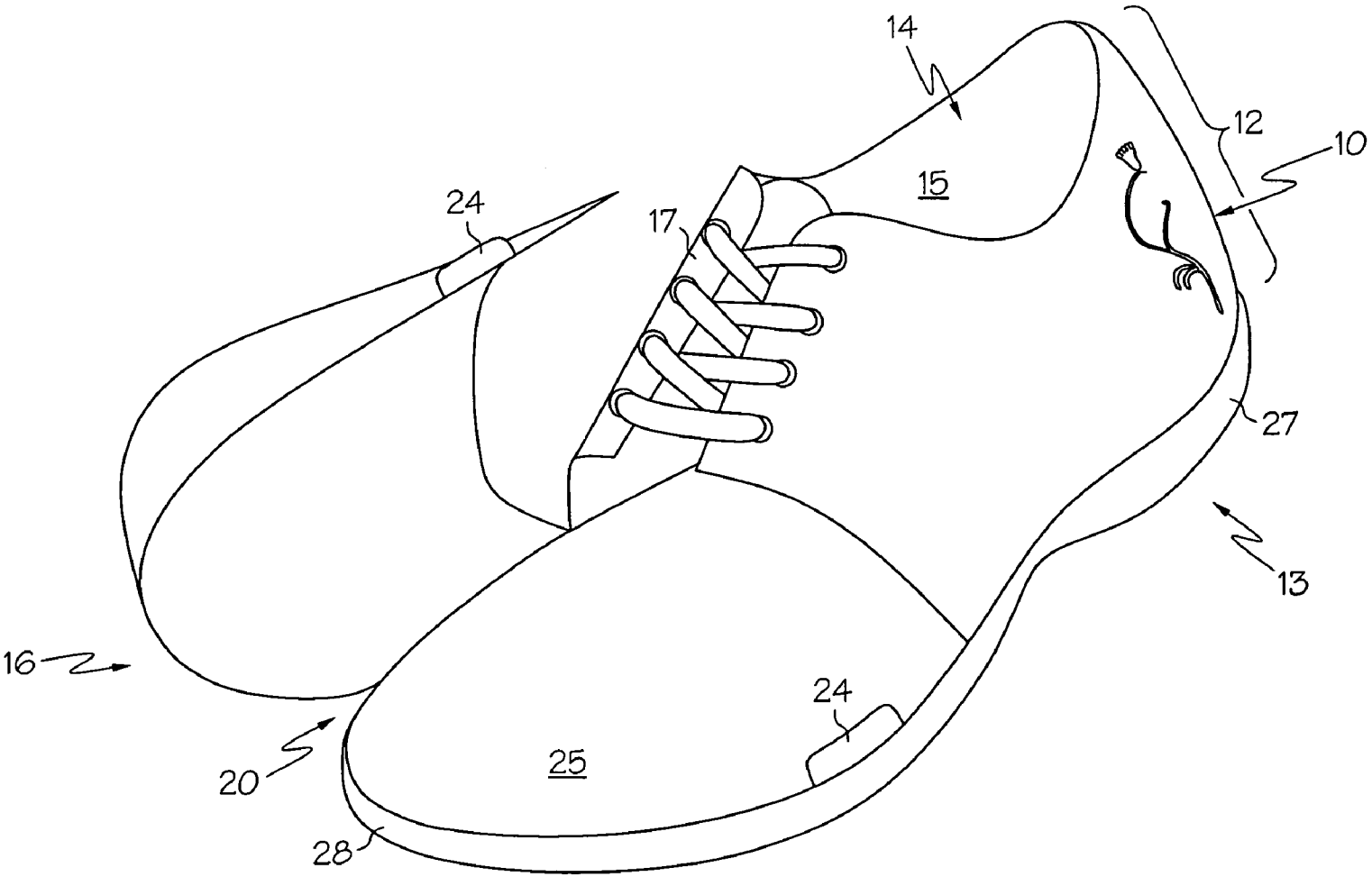
FIG. 3 is an oblique view of a pedicure shoe with the toe flap in an open position.

The following description is exemplary in nature and is in no way intended to limit the scope of the invention as defined by the claims appended hereto. Referring to FIGS. 1–3, a toe enclosure is shown in the form of a pedicure shoe 10 including an upper 12 and a sole 13. The upper 12 includes a mouth 14 for receiving a foot into the cavity 15, a toe flap 16 for covering the toes of a foot, and laces 17. The toe flap 16 is attached to the upper 12 via a hinge member 20 on the right side of the shoe 10. The toe flap 16 includes a securing device 24 on the left side of the shoe 10 for securing the flap to the upper 12 and/or sole 13. The sole includes a top surface 25, a bottom surface 26 a heel portion 27, and a toe portion 28. In FIG. 1, the toe flap 16 is in a closed position with the securing device 24 releasably attaching the toe flap 16 to the shoe sole 13.

Turning to FIGS. 2 and 3, the pedicure shoe 10 is shown with the toe flap 16 in an open position. The toe flap 16 opens from the left side of the shoe 10, pivoting about the hinge member 20 located on the right side of the shoe 10. The hinge member 20 may be any suitable device for allowing the toe flap to pivot. For example, a simple crease in the fabric of the toe flap may be a suitable hinge member. It will be appreciated that the toe flap 16 is configured to open sufficiently wide so that the toe flap 16 does not interfere with the toes of a foot when a foot is inserted into the pedicure shoe 10. The toe flap 16 also functions to provide access to the toes of a foot without requiring removal of the pedicure shoe 10. The securing device 24 may be used for securing the toe flap 16 in a closed position. The securing device 24 may be any suitable device for releasably attaching the toe flap 16 to the upper 12 and/or sole 13. For example, a hook and loop fastener, such as Velcro, or a zipper or snap may be used to secure the toe flap 16 to the upper 12 and/or sole of the pedicure shoe 10 when the toe flap 16 is in a closed position.

Figure 4:
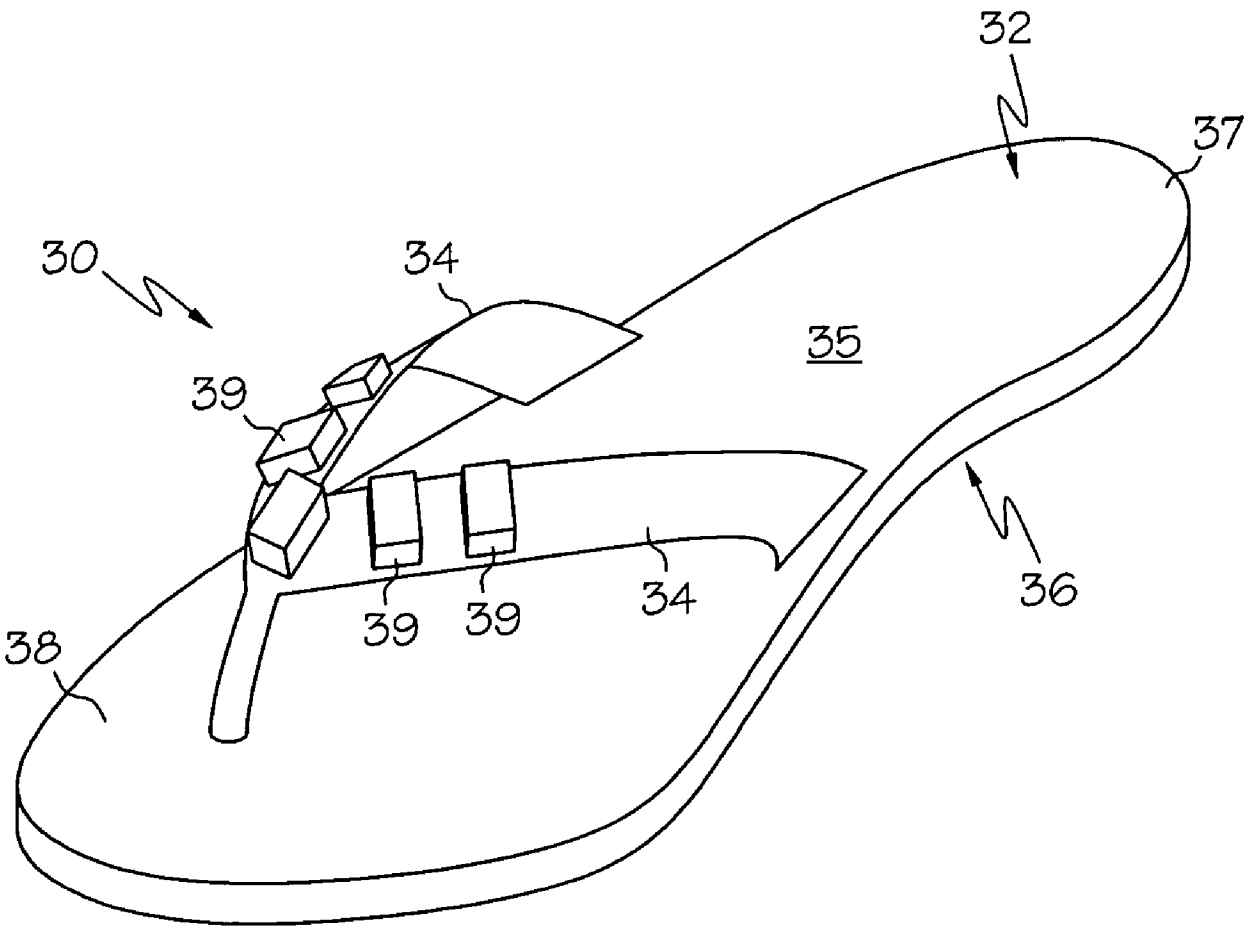
FIG. 4 is an oblique view of a pedicure slipper.

Turning to FIG. 4, a foot support in the form of a pedicure slipper 30 is shown. The pedicure slipper 30 includes a slipper sole 32 and slipper strap 34. The slipper sole 30 includes a top surface 35, a bottom surface 36, a heel portion 37, and a toe portion 38. The slipper strap 34 is typically configured such that when a foot is inserted into the slipper 30, the slipper strap 34 secures the slipper 30 to the foot. Other types of slipper straps may be used. For example, a slipper strap that extends across the top of the foot behind the toes of the foot. The slipper strap 34 in the illustrated embodiment includes one or more spacer members 39 adjustably attached to the slipper strap 34. As will be more fully understood in view of the following paragraphs, the spacer members 39 provide a protected space between the toes of a foot and a pedicure shoe when the slipper 30 is used in conjunction with a pedicure shoe of the present invention. The slipper strap 34 itself may also be configured to perform the function of the spacer members 39. In addition, the spacer members 39 may be integrated with the slipper strap 34.

Figure 5:
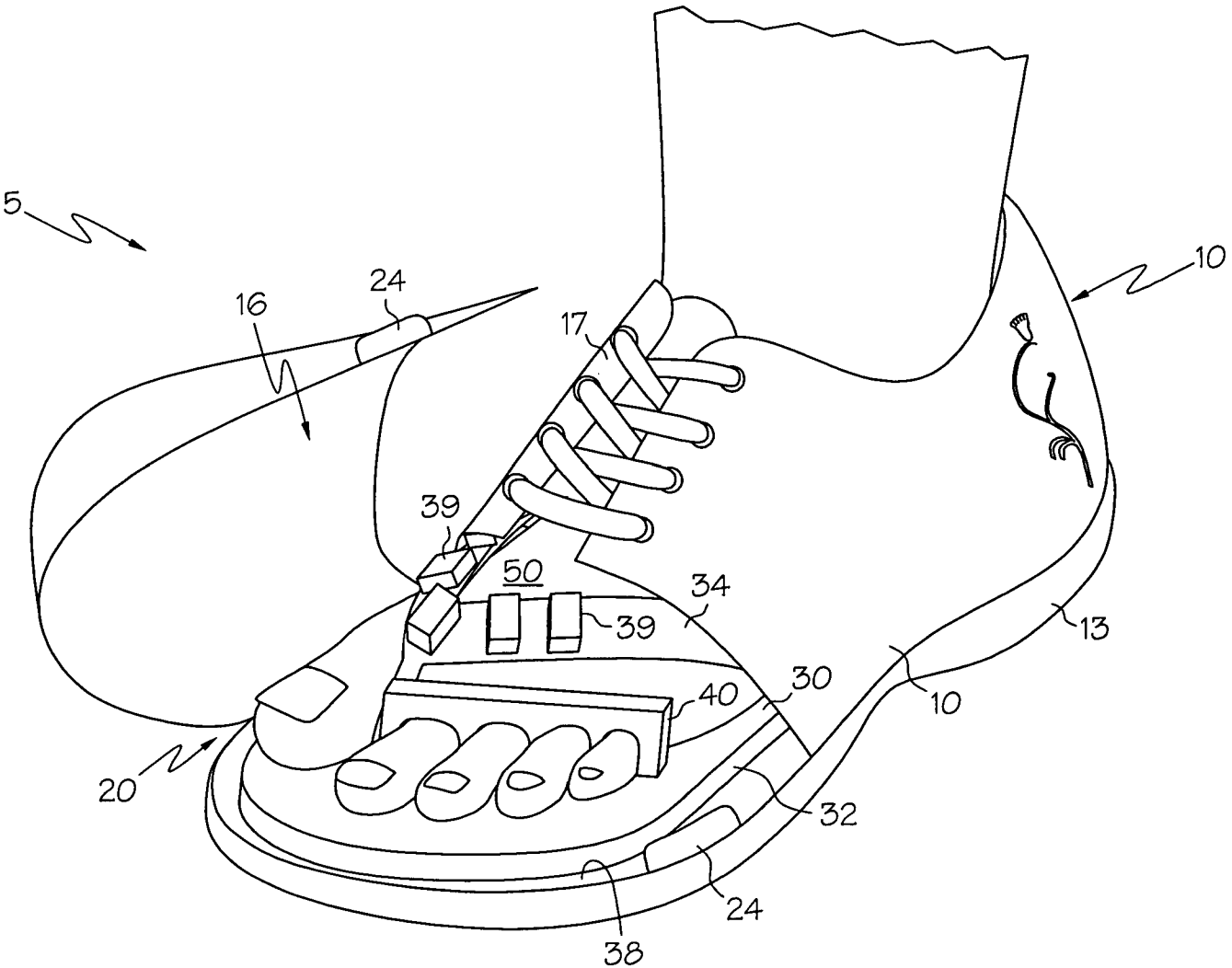
FIG. 5 is an oblique view of a pedicure shoe system of the present invention.

In FIG. 5, a pedicure shoe system 5, including toe spacers 40, is shown. A foot 50 held to a pedicure slipper 30 with pedicure strap 34 is shown positioned in a pedicure shoe 10. As noted, the pedicure slipper 30 includes a slipper sole 32 and one or more slipper straps 34 for holding the pedicure slipper 30 to the foot 50. Spacer members 39 are disposed on the pedicure slipper straps 34 to provide proper spacing between the top of the foot 50 and the interior of the toe flap 16 of the pedicure shoe 10 when the toe flap is in the closed position. The sole 32 of the pedicure slipper 30 preferably is configured to fit securely within the interior of the pedicure shoe 10 to provide a stable walking surface by preventing the pedicure slipper 30 from shifting within the pedicure shoe 10. However, the sole 32 of the pedicure slipper 30 need not securely fit within the pedicure shoe 10, and thus a wide variety of pedicure slipper sole 32 configurations are possible. As will be described in more detail herein, the pedicure slipper 30 and/or pedicure shoe also may include an engagement device for engaging the sole of the pedicure shoe 10 when inserted into the cavity of the pedicure shoe 10.

In the embodiment of FIG. 5, the slipper strap 34 and/or spacers 39 ensure adequate spacing between the interior of the toe flap 16 and toes of a foot, when the toe flap 16 is secured in a closed position. The toe spacers 40 may also be configured to not only space apart the individual toes of the foot, but to also ensure adequate spacing between the interior of the toe flap 16 and the toes. Thus, the slipper strap 34, spacer members 39, toe spacers 40, and toe flap 16 cooperate to provide a protective covering to freshly polished nails by preventing the nails from contacting foreign objects or materials outside the shoe and also the inside of the shoe itself. The spacer members 39 may be attached to and/or integrated into any suitable component of the pedicure shoe 10, the slipper 30, or both. Some of the spacer members 39 may be adjustably attached to the pedicure slipper 30 and/or shoe 32. Preferably, the spacer members 39 are adjustably attachable to the slipper strap 34 such that the position of the spacer members 39 may be adjusted to enable an individual to position the spacers members 39 in the most comfortable position, and to ensure that adequate space is provided between the toe flap 16 and the toes of a foot. Further, adjustably attachable spacer members 39 may be retrofitted onto conventional pedicure slippers thereby ensuring adequate spacing between the toe flap 16 and toes when a conventional pedicure slipper is used in conjunction with the pedicure shoe 10 of the present invention. The spacer members 39 may be resilient and/or flexible such that the spacer members 39 adapt to the surfaces between which they are situated.

It will be appreciated that in practice the pedicure slipper 30, secured or held to the foot 50, may be inserted into the pedicure shoe 10 via the mouth 14 of the pedicure shoe 10 with the toe flap 16 in an open position. Alternatively, the pedicure slipper 30 may be placed into the cavity 15 of the pedicure shoe 10 and, with the toe flap 16 in an open position, an individual's foot then may be inserted into the pedicure shoe 10 via the mouth 16 and subsequently secured to the pedicure slipper 30 with the slipper straps 34. It will further be appreciated that, with the toe flap 16 in the open position, the laces 32 on the pedicure shoe 10 may be completely unlaced thereby providing an unobstructed path to insert a foot with or without a pedicure slipper 30 into the pedicure shoe 10.

The sole 32 of the pedicure slipper 30 may be flexible yet rigid enough to provide a suitable walking surface when the slipper 30 is not used in conjunction with the pedicure shoe. The slipper sole 32 may be configured to correspond to the cavity 15 of the pedicure shoe 10 such that the pedicure slipper sole 32 is substantially fixed against longitudinal and transverse movement when the pedicure slipper 30 is positioned in the pedicure shoe 10. For example, the bottom surface 36 of the slipper sole 32 may include various recesses for engaging various mating projections in the top surface 25 of the shoe sole 13 when the pedicure slipper 30 is positioned with the pedicure shoe 10. The pedicure slipper 30 and/or pedicure shoe 10 also may include an engagement device for releasably securing the pedicure slipper 30 to the interior of the pedicure shoe 10 when the pedicure slipper 30 is positioned within the pedicure shoe 10. For example, the pedicure slipper 30 may be sized to form a friction lock with the pedicure shoe 10 when the pedicure slipper 30 is inserted into the pedicure shoe 10. Other releasably fasteners may also be used, such as snaps or Velcro, either alone or in combination with the friction lock, or in combination with each other.

Figure 6:
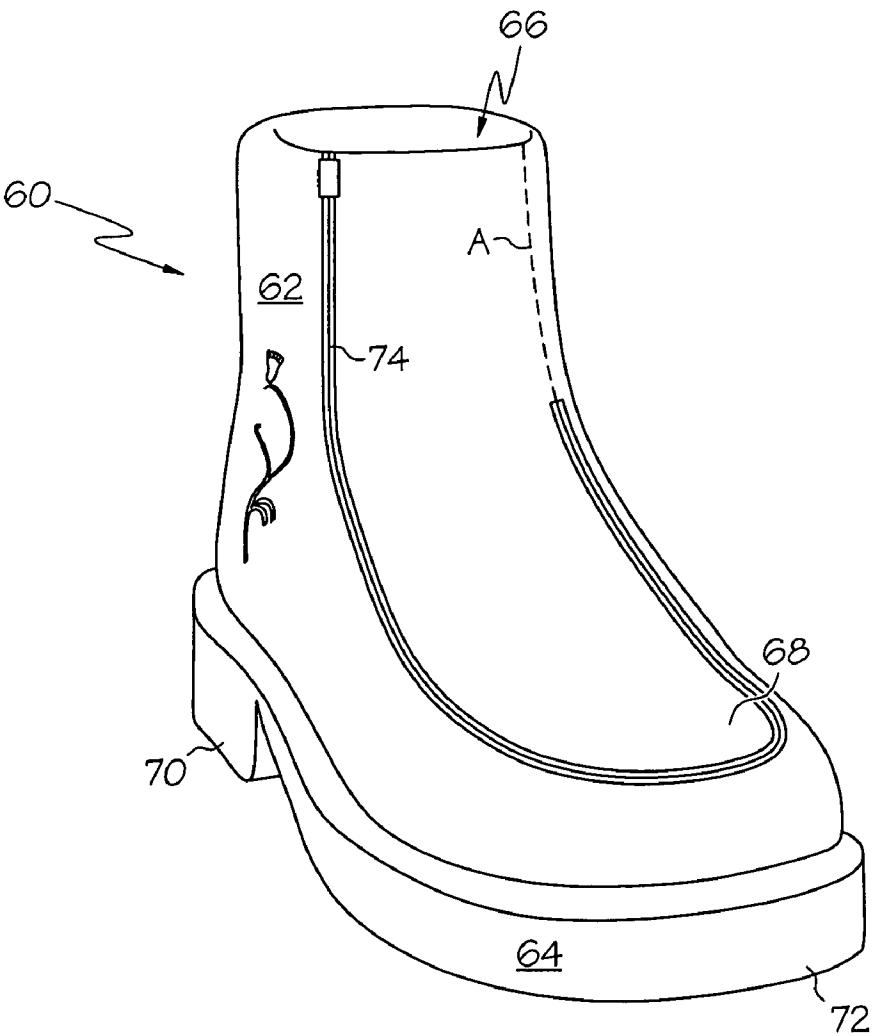
FIG. 6 is an oblique view of a pedicure boot according to another embodiment of the present invention.
Figure 7:
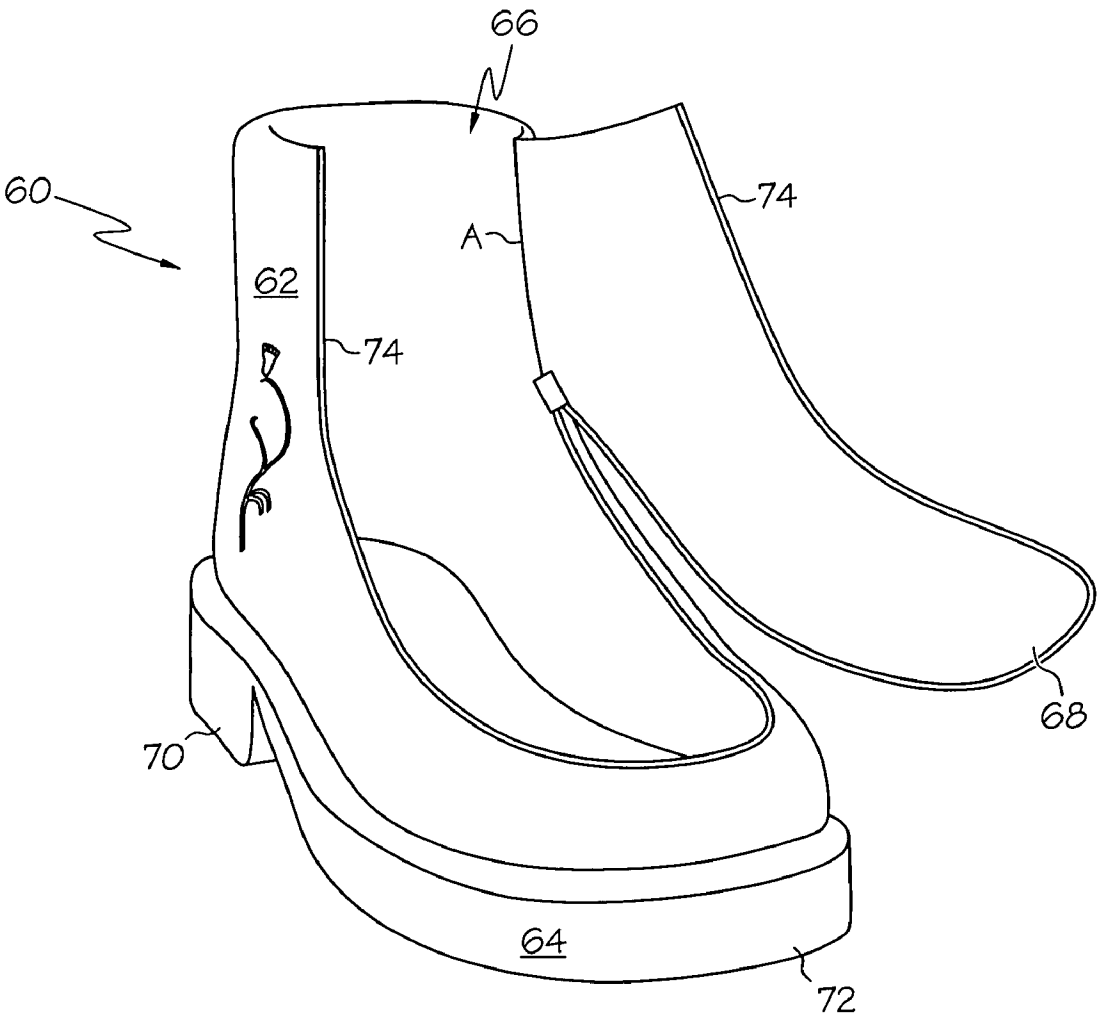
FIG. 7 is an oblique view of a pedicure boot according to the present invention.

Turning to FIGS. 6 and 7, another embodiment of a pedicure shoe is shown. It will be appreciated that the foregoing discussion of the pedicure shoe in FIGS. 1–5 is equally applicable to the pedicure shoe of FIGS. 6 and 7. In this embodiment, the toe enclosure is in the form of a pedicure boot 60 including an upper 62 attached to a sole 64. The upper includes a mouth 66 and a toe flap 68. The sole 64 includes a heel portion 70 and a toe portion 72. An entry zipper 74 extends from the mouth 66 down the upper 62 towards the heel portion 70 of the sole 64 and continues along one side of the upper 62 parallel to the sole 64, around the toe portion 72 of the sole 64, and down a portion of the length of the opposite side of the upper 62. In general, the entry zipper 74 may be configured such that, when an individual's foot is placed in the boot 60, the entry zipper 74 extends from the mouth 66 down along one side of the ankle of the individual's foot, forward around the individual's toes, and down the other side of the individual's foot towards the base of the other side of the individual's ankle.

In this embodiment, the toe flap 68 is handedly attached to the upper 62 along the line marked A. When the entry zipper 74 is unzipped, the toe flap 68 is configured to open along the line A from front to back. When the entry zipper 74 is zipped, the toe flap 68 is secured to the sole 64 and covers the toes of the foot thereby protecting against inadvertent contact between the toenails and foreign objects and/or weather.

The pedicure boot 60 of FIGS. 6 and 7 is configured to receive a pedicure slipper in a similar manner as the pedicure shoe 10 previously described. It will be appreciated that the entry zipper 74 allows the entire upper 62 of the boot 60 to open to receive a pedicure slipper secured to an individual's foot.

It will be appreciated that the pedicure shoe 10 and pedicure boot 60 may be configured for use in conjunction with a wide range of conventional pedicure slippers existing in the marketplace. Thus, as described above, the pedicure slipper 30 may be either a conventional pedicure slipper or a specialized pedicure slipper made especially for use in connection with the pedicure shoe 10 and/or the pedicure boot 60, such as the pedicure slipper 30 disclosed above. The ability of the pedicure shoe 10 to be used in conjunction with existing pedicure slippers allows the pedicure shoe 10 to be used with a pedicurist's existing or preferred pedicure slipper.

In any one of the above-described embodiments, suitable water repellant and/or waterproofing measures may be employed to provide the pedicure shoe and an individual's foot with adequate protection from the elements. Further, the pedicure shoe and pedicure slipper may be made from a wide variety of suitable materials including leather, plastic, and rubber. Similarly, the toe spacers and spacer members may be made of foam rubber, plastic, cloth, leather, or any other suitable material.

Although the invention has been shown and described with respect to certain preferred embodiments, other equivalents and modifications will occur to others skilled in the art upon the reading and understanding of the specification. The present invention includes all such equivalents and modifications, and is limited only by the scope of the following claims.

What is claimed is:

1. A shoe system for protecting the toes of a foot comprising:

a shoe member having a shoe sole and an upper attached to at least a portion of the perimeter of the shoe sole thereby defining a cavity, the upper including a mouth portion and a toe enclosure releasably attachable to at least a portion of the shoe sole;

a slipper member separate from and positionable in the cavity of the shoe member, the slipper member having a slipper sole and a strap member attached to the slipper sole; and at least one spacer member configured to separate at least a top part of the slipper from the toe enclosure when the slipper member is positioned in the shoe member.

2. A protector for toes of a foot as set forth in claim 1, wherein the slipper member includes a recess in a bottom surface thereof for receiving a projection extending from the shoe sole when the slipper member is positioned in the cavity of the shoe member, whereby the slipper member is secured against movement relative to the shoe member.

3. A shoe system as set forth in claim 1, wherein the shoe member is configured to engage the slipper member to secure the slipper member against movement relative to the shoe member when the slipper member is positioned in the cavity of the shoe member.

4. A shoe system as set forth in claim 1, wherein the at least one spacer member is adjustable attached to the strap member such that when the slipper member is positioned in the cavity of the shoe member the spacer member is disposed between the foot and at least one of the upper and toe enclosure.

5. A shoe system as set forth in claim 1, wherein the upper further comprises a first side panel attached to a first side of the shoe sole and a second side panel attached to a second side of the shoe sole, the first side panel and the second side panel being releasably attachable to one another.

6. A shoe system as set forth in claim 1, wherein the toe enclosure is flexibly attached along a first side to at least one of the shoe sole and the upper, and wherein the toe enclosure includes a securing device for releasably attaching the toe enclosure along at least a second side to at least one of the shoe sole and the upper.

7. A shoe system as set forth in claim 1, further comprising at least one toe spacer configured to separate the toes of the foot.

8. A shoe system as set forth in claim 1, wherein the shoe member is a boot.

* * * * *